United States Patent [19]

Takahashi et al.

[11] 4,340,422

[45] Jul. 20, 1982

[54] POWDERY DESULFURIZER COMPOSITION

[75] Inventors: Atsushi Takahashi, Tokyo; Yoshiharu Muratsubaki, Uozu; Hiroyuki Ishizuka, Mitaka, all of Japan

[73] Assignee: Nippon Carbide Kogyo Kabushiki Kaisha, Tokyo, Japan

[21] Appl. No.: 263,306

[22] Filed: May 13, 1981

[30] Foreign Application Priority Data

May 20, 1980 [JP] Japan ..... 55/65924

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,955,966 | 5/1976 | Meichsner | 75/58 |
| 4,049,442 | 9/1977 | Freissmuth | 75/53 |
| 4,139,369 | 2/1979 | Kandler | 75/58 |
| 4,142,887 | 3/1979 | Luyckx | 75/58 |
| 4,277,279 | 7/1981 | Kerlin | 75/58 |

*Primary Examiner*—P. D. Rosenberg

*Attorney, Agent, or Firm*—Sherman & Shalloway

[57] ABSTRACT

A powdery desulfurizer composition for injection desulfurization of molten iron, said composition comprising quicklime, diamide lime and calcium carbide.

6 Claims, No Drawings

POWDERY DESULFURIZER COMPOSITION

BACKGROUND OF THE INVENTION

1. Field of the Invention

This invention relates to a powdery desulfurizing agent comprising quicklime, diamide lime and calcium carbide as main ingredients. More specifically, the invention pertains to a powdery desulfurizer composition comprising quicklime, diamide lime and calcium carbide as main ingredients, which is especially effective in injection desulfurization of molten iron.

The diamide lime is a mixture consisting essentially of calcium carbonate and carbon.

The term "molten iron" as used herein, denotes a molten mass of pig iron, cast iron, steel, etc.

2. Description of the Prior Art

As is well known, desulfurization of molten iron is an important treatment for obtaining iron and steel products having excellent properties, and numerous desulfurizing agents and desulfurizing methods have been proposed heretofore.

Calcium carbide has by far the best desulfurizing ability, and desulfurizers comprising calcium carbide as a main ingredient have gained widespread acceptance. Production of calcium carbide, however, entails high electric power consumption, and it has become necessary to re-assess calcium carbide as a desulfurizer from an economical viewpoint in order to cope with the recent rise in energy cost. On the other hand, quicklime is known as one of cheaper desulfurizers. Although the iron and steel industry desires commercial utilization of quicklime, its very low desulfurizing performance has made it difficult to meet various high-level requirements in the present-day desulfurization of molten iron.

A method which comprises adding a certain powdery desulfurizing agent to molten iron and mechanically stirring the mixture and a method which comprises injecting a certain powdery desulfurizing agent into molten iron using a carrier gas are well known for desulfurization of molten iron. The injection desulfurizing method has gained widespread acceptance because of its excellent operational ease and desulfurizing efficiency. Specifically, the injection desulfurizing method comprises carrying a powdery desulfurizing agent on a stream of a carrier gas such as dry nitrogen, and injecting it into molten iron through a lance submerged in molten iron. According to a widely accepted practice of injection desulfurization, a torpedo car which has received molten pig iron from a blast furnace, for example, is stopped for a while at a desulfurizing station on its way to a steel-making factory, and a powdery desulfurizing agent is injected into molten iron in the torpedo car during this stop. Furthermore, injection desulfurization in an open ladle has been put into operation in recent years in place of the mechnically stirring desulfurizing method (e.g., the so-called KR method in an open ladle) because of its excellent operational ease and desulfurizing efficiency.

The term"injection desulfurization", as used in the present application, is a term contrastive with "desulfurization methods which involve preaddition of desulfurizers or mechanical stirring desulfurization", etc., and specifically denotes a method of desulfurization which comprises injecting a powdery desulfurizing agent together with a carrier gas into molten iron beneath its surface.

The injected desulfurizing agent escapes from the carrier gas in molten iron and makes contact with the molten iron, whereupon it reacts with sulfur in the molten iron. Then, the desulfurizing agent and/or its reaction product with sulfur rise through the molten iron and finally float as desulfurization slag on the surface of the molten iron. The molten iron is sufficiently moved and stirred by the carrier gas and/or gases which may be evolved from gas-generating substances in the powdery desulfurizing agent, and as a result, the chances of the desulfurizer to encounter sulfur in molten iron are enhanced, and the residual sulfur content in the molten iron is geometrically uniformed.

Methods for improving the desulfurizing ability of quicklime have been proposed, for example, in Japanese Laid-Open Patent Publications Nos. 38209/1979, 50414/1979, 86416/1979, and 86417/1979 which are directed mainly to size reduction of CaO crystals constituting quicklime so as to increase its contact area and thereby improve its reactivity. It has been found, however, that when quicklime treated by the methods disclosed in these prior patent documents is used in injection desulfurization of molten iron, its transportability on a stream of a carrier gas is very poor, a large amount of the carrier gas is required, and therefore injection of the quicklime in high concentrations and fine dispersion in the carrier gas is difficult, and consequently that the advantage of the finely divided CaO crystals cannot be utilized and the expected desulfurizing effect cannot be obtained. It is thus seen that although the reduction of the particle size of a desulfurizing agent has greatly to do with an increase in desulfurizing ability, its desulfurizing performance is not directly governed by its particle size, but also it is greatly affected by the transportability of the desulfurizing agent on a carrier gas.

In the injection desulfurizing method, the powdery desulfurizing agent is injected into molten iron in a form suspended in carrier gas. That part of the powdery desulfurizing agent which has escaped out of the gas bubbles of the gas stream makes direct contact with the molten iron and reacts with sulfur in the molten iron, but that portion of the desulfurizing agent which remains enclosed within the gas bubbles rises as such and floats on the surface of the molten iron without contributing to the desulfurization reaction or spurts out of the molten iron together with the gas.

In order to increase the proportion of the desulfurizer powder which participates in the desulfurization reaction and to increase its reactivity, it is desirable to minimize the amount of the carrier gas, thereby preventing the desulfurizing agent from being enclosed within the gas bubbles. The amount of the carrier gas required for injection, however, depends upon the gas transportability of the powdery desulfurizing agent, and a desulfurizing agent which has poor gas transportability requires a large amount of a carrier gas for injection. Accordingly, even a desulfurizing agent having high reactivity cannot give the desired desulfurizing effect in injection desulfurization if its transportability on a carrier gas is poor.

Furthermore, when the desulfurizing agent has poor gas transportability, great fluctuation occurs in the concentration of the desulfurizing agent in the carrier gas in injection desulfurization to cause a pulsating movement of the desulfurizer carrier gas stream which frequently becomes an operational trouble. For example, injection of an excessively large amount of the powdery desulfurizing agent into molten iron at one time, results in an excessively large amount of gas evolution at one time in the molten iron and thus increases vibration of a torpedo car, an open ladle, etc. The fluctuations in the concentration of the desulfurizing agent also can result in the desulfurizing agent blocking up the lance pipes, or the molten iron splashing vigorously out of the torpedo car, etc, and thus causing undesirable phenomena such as the pollution of the working environment, exposure to danger, and economical loss.

The present inventors made various investigations in order to improve the performance of quicklime in injection desulfurization with special attention to the poor gas transportability of various quicklime desulfurizers so far proposed, and unexpectedly found that a powdery desulfurizing composition comprising a specified amount of powdery quicklime and a specified amount of powdery diamide lime gives a complete solution to the aforesaid various problems associated with quicklime.

This powdery desulfurizer composition was applied for a patent in co-pending Japanese Patent Application No. 61261/1980 filed May 10, 1980.

It has recently been found however that the desulfurizing ability of the desulfurizer composition of the co-pending Patent Application is not sufficient in the production of ultralow sulfur iron having a sulfur content of 0.010% or less which is especially required in steel making, and a further improvement is desired.

SUMMARY OF THE INVENTION

The present inventors furthered their investigations in order to improve the desulfurizing ability of the powdery desulfurizer composition of the above Patent Application for production of ultralow sulfur iron by injection desulfurizing method, and unexpectedly found that a powdery desulfurizer composition comprising quicklime, diamide lime and calcium carbide permits a marked increase in the ratio of calcium carbide utilized by the incorporation of quicklime and diamide lime, exhibits an equivalent desulfurizing ability to conventional powdery desulfurizer compositions consisting mainly of calcium carbide in amounts equal to, or less than, the amounts of the conventional calcium carbide desulfurizer compositions, and can give ultralow sulfur within short desulfurizing treatment times, and also it can be provided at low cost.

According to this invention there is provided a powdery desulfurizer composition for use in injection desulfurization of molten iron, said composition comprising quicklime, diamide lime and calcium carbide.

In a preferred embodiment, the composition of this invention further comprises not more than 10 parts by weight of a carbonaceous material and/or 2 to 8 parts by weight of one or more desulfurization aids, particularly fluorspar, per 100 parts by weight of the quicklime, diamide lime and calcium carbide combined.

DETAILED DESCRIPTION OF THE INVENTION

The "quicklime", as used in the present application, denotes lime containing calcium oxide in an amount of at least 60% by weight, preferably at least 70% by weight, more preferably at least 80% by weight, most preferably at least 90% by weight.

Quicklime is generally obtained by calcining lime materials containing calcium carbonate as a main component, such as limestone, calcite, marble and shells of shellfish in such a thermal decomposition device as a vertical kiln fired by heavy oil, gases or their mixtures, or a rotary kiln, and is supplied in suitable degrees of purity and suitable extents of calcining depending upon the end uses. For industrial use, there are, for example, quicklime for steel-making, quicklime for chemical industry (production of calcium carbide, bleaching agents and paper pulp), quicklime for agriculture, and quicklime for construction work. Usually, quicklime is marketed as special grade (CaO content 90% by weight or more), first grade (CaO content 80% or more), second grade (CaO content 70% by weight or more), and third grade (CaO content 60% by weight or more). Quicklime of any of these grades can be used in the desulfurizer composition of this invention. However, quicklime containing calcium oxide in an amount of at least 60% by weight, preferably at least 70% by weight, more preferably at least 80% by weight, most preferably at least 90% by weight can be used with good results in injection desulfurization of molten iron.

The term "diamide lime", as used in this invention, denotes a mixture of fine calcium carbonate and carbon precipitated from an aqueous solution or aqueous suspension by a chemical reaction. A typical example of the "diamide lime" is a by-product filtration residue in the production of dicyanidamide. In this process, an aqueous suspension of calcium cyanamide is reacted with carbon dioxide gas and cyanamide is extracted. The filtration residue obtained generally contains 70 to 90% by weight of calcium carbonate, 5 to 15% by weight of carbon and impurities such as iron oxide, aluminum oxide, silicon oxide and magnesium oxide. In the production of thiourea from calcium cyanamide, a similar by-product is obtained. Thus, generally, filtration residues obtained in the extraction of cyanamide from calcium cyanamide have much the same composition.

The term "calcium carbide", as used herein generally denotes industrial carbide. Usually, it is marketed in grades capable of generating about 275 to about 300 liters/kg of acetylene and having a $CaC_2$ content of about 75 to about 82%. These industrial grades of carbide can be used without any restriction. In addition to $CaC_2$, the industrial carbide contain free carbon, silica $SiO_2$, iron oxide, quicklime, magnesium oxide, aluminum oxide, calcium carbonate, calcium fluoride, calcium phosphide, etc.

The weight proportions of the quicklime, diamide lime and calcium carbide constituting the desulfurizer composition of this invention are not particularly restricted. Advantageously, the composition consisting of 90 to 60% by weight of quicklime and diamide lime combined and 10 to 40% by weight of calcium carbide with the amount of quicklime being 30 to 80 parts by weight and the amount of the diamide being 70 to 20 parts by weight provided that the total amount of the quicklime and diamide lime is 100 parts by weight. Especially preferably, the composition of this invention comprises 85 to 65% by weight of quicklime and diamide lime combined and 15 to 35% by weight of calcium carbide with the amount of quicklime being 40 to 60 parts by weight and the amount of the diamide lime being 60 to 40 parts by weight provided that total amount of the quicklime and diamide lime is 100 parts by weight.

If the amount of quicklime and diamide lime in the powdery desulfurizer composition exceeds 90% by weight, the amount of calcium carbide decreases and the desulfurizing ability of the composition tends to decrease. Accordingly, to obtain ultralow sulfur iron, a large amount of the desulfurizer composition must be injected into molten iron, and the desulfurizing treatment is time-consuming. As a result, this affects the time schedule of a continuous casting process, etc. If the total amount of quicklime and diamide lime is less than 60% by weight, the amount of the calcium carbide increases and accordingly, the amount of that portion of the calcium carbide which does not contribute to the desulfurizing action of the composition increases. Thus, the decrease of the unit consumption and the shortening of the desulfurizing time are achieved to a lesser extent than the desulfurizer composition of this invention containing 10 to 40% by weight of calcium carbide, and such a composition is economically disadvantageous. In order to obtain a powdery desulfurizer composition of the invention which fully exhibits the desulfurizing ability of calcium carbide, permits decreasing of the unit consumption and the shortening of the desulfurizing time and which is economically advantageous, the total amount of quicklime and diamide lime is especially preferably 85 to 65% by weight.

When the total amount of quicklime and diamide lime is taken as 100 parts by weight, it is preferred that the amount of quicklime is 30 to 80 parts by weight, and the amount of the diamide lime is 70 to 20 parts by weight. If the proportion of the diamide lime exceeds 70 parts by weight, the amount of gases generated from the desulfurizer composition in molten iron increases and the molten iron tends to splash. Also, the consequently decrease of quicklime tends to decrease the desulfurizing ability of the composition. If the proportion of diamide lime is less than 20 parts by weight, the gas transportability of the resulting composition is reduced, and injection of the desulfurizer composition, which exhibits the inherent excellent desulfurizing ability of quicklime, in high concentrations is difficult. In order to have the inherent excellent desulfurizing ability of quicklime exhibited fully without the problems of splashing and gas transportability, it is preferred that the amount of quicklime is 40 to 60 parts by weight and the amount of the diamide lime is 60 to 40 parts by weight with the total amount of these being 100 parts by weight.

The quicklime, diamide lime and calcium carbide and a carbonaceous material to be described hereinbelow preferably have a particle sizes of mainly not more than 60 microns. In the present application, the expression "mainly not more than 60 microns" means that the proportion of particles having a particle diameter of not more than 60 microns is at least 80% by weight, preferably at least 90% by weight, and in particular, the proportion of particles having particle diameters of not more than 40 microns is at least 80% by weight, preferably at least 90% by weight. If the particle diameter is mainly above 60 microns, the particles are too coarse to secure good gas transportability, and thus the concentration of the powdery desulfurizer composition in a carrier gas during injection can fluctuate greatly, and the surface area of the particles per unit weight decreases. Hence, the desulfurizing abilities of quicklime and calcium carbide cannot be utilized fully.

The desulfurizer composition of the invention can be injected with a carrier gas into molten iron by using known devices such as a device adapted to feed the powdery desulfurizer in specified portions down from its tank into an injection pipe line by means of a rotary valve and transport it on the carrier gas (e.g., Japanese Laid-Open Patent Publication No. 102515/1975), or a device adapted to fluidize the powdery desulfurizer placed in a pressure vessel and inject it by using the carrier gas.

The desulfurizer composition of this invention is suitable for use in many injection desulfurization methods using various devices including the aforesaid devices. Even when a relatively large amount of the carrier gas is used as in Japanese Patent Publications Nos. 6454/1974 and 1967/1974 in which the proportion of the amount of the carrier gas is about 100 Nl per kilogram of the powdery desulfurizer composition, the desulfurizer composition of the invention can be used by properly selecting the injection angles or lance declinations, the number of injection places, the geometrical locations of injection, etc.

The "apparatus for dispensing a flowable solid material from a pressure vessel" disclosed in Japanese Laid-Open Patent Publication No. 31518/1979 is one of especially preferred injection devices which leads to full utilization of the effect of the powdery desulfurizer composition of this invention. This device has gained widespread commercial acceptance because it permits injection into molten iron of the powdery desulfurizing agent in high concentrations. If the amount of the carrier gas per unit amount of the powdery desulfurizer is small, the total amount of the carrier gas required for injecting can be small. Accordingly, the degree of temperature lowering of molten iron is small, and the apparatus can be small-sized. In injection desulfurization using this type of the device, the proportion of the carrier gas can be suitably not more than 10 Nl, preferably 2 to 10 Nl, for example 5 Nl, per kilogram of the powdery desulfurizer composition. At such a low carrier gas proportion, the gas transportability of the powdery desulfurizer composition is of utmost importance. The powdery desulfurizer composition of this invention having excellent gas transportability is most effective under such conditions.

Accordingly, the powdery desulfurizer composition of the invention is suitable for use in an injection desulfurizing method particularly the one which comprises fluidizing the powdery desulfurizer composition in a pressure vessel, and injecting it into molten iron using a carrier gas in an amount of not more than 10 Nl per kilogram of the desulfurizer composition.

The present inventors have also found unexpectedly that when fine quicklime is produced by calcining diamide lime, and this quicklime is used in combination with diamide lime, the resulting composition has more improved gas transportability and further improved desulfurizing ability.

Japanese Laid-Open Patent Publication Nos. 50414/1979 and 86417/1979 cited above disclose that by calcining diamide lime under special conditions, quicklime having good desulfurizability can be obtained. However, calcining of diamide lime to obtain the aforesaid quicklime does not require any special calcining conditions although no clear reason can be assigned. Quicklime obtained by calcining diamide lime until its CaO content reaches at least 60% by weight, preferably at least 70% by weight, more preferably at least 80% by weight, most preferably at least 90% by weight can be used with good results in injection desulfurization of molten iron. However, fluidized calcination under oxygen-excessive atmosphere can be used preferably to produce the quicklime for this invention.

The quicklime obtained by calcining diamide lime may be mixed in any desired proportions with quicklimes from other more conventional lime sources. But since the quicklime obtained by calcining of diamide lime imparts better gas transportability and greater desulfurizing ability, it is preferred to use 90 to 60% by weight of quicklime obtained by calcining diamide lime and diamide amide combined and 10 to 40% by weight of calcium carbide with the amount of the quicklime obtained by calcining diamide lime being 30 to 80 parts by weight and the amount of diamide lime being 70 to 20 parts by weight provided that the total amount of the quicklime and diamide is 100 parts by weight. More preferably, these components are used in a particle diameter of mainly not more than 60 microns. It is especially preferred to use 85 to 65% by weight of quicklime obtained by calcining diamide lime and diamide lime combined and 15 to 35% by weight of calcium carbide with the amount of the quicklime obtained by calcining diamide lime being 40 to 60 parts by weight and the amount of the diamide lime being 60 to 40% by weight provided that the total amount of these components is 100 parts by weight.

In accordance with this invention, it has also been found that when not more than 10 parts by weight, preferably 3 to 10 parts by weight, of a carbonaceous material is added to 100 parts by weight of a powdery desulfurizer composition composed of quicklime, diamide lime and calcium carbide, the resulting mixture shows more improved gas transportability and desulfurizing ability suitable for use in desulfurization of molten iron.

Examples of the carbonaceous material are graphite, coal, coke, petroleum coke, and charcoal. There is no particular restriction on its kind and properties. It is desirable however that such a carbonaceous material should have a low sulfur content and a low water content so as to use it with quicklime. Coal and coke are preferred carbonaceous materials in view of their ready availability and low cost. The carbonaceous material desirably has a particle diameter of mainly not more than 60 microns as stated hereinabove.

If the amount of the carbonaceous material exceeds 10 parts by weight per 100 parts by weight of the powdery desulfurizer composition composed of quicklime, diamide lime and calcium carbide, the amount of the carbonaceous material in exhaust gases from, for example, an open ladle in the injection desulfurization process increases to cause various working environmental troubles such as higher exhaust gas temperature, flushing danger, and/or the increased amount of carbon monoxide.

The powdery desulfurizer composition for molten iron of this invention is inexpensive and exhibits excellent desulfurizing performance in injection desulfurization with effects comparable to conventional calcium carbide desulfurizer compositions. Its desulfurizing effect can be further improved by using it in combination with various conventional desulfurizing agents and desulfurization aids. Examples of these conventional materials include calcium cyanamide, fluoride compounds such as fluorspar or cryolite; oxide, hydroxide, carbonate or other compounds of sodium, magnesium or aluminum; calcium hydroxide, powders of synthetic resins, and compounds capable of liberating water or hydrogen in the desulfurization system. Fluorspar and cryolite are preferred, and fluorspar is especially preferred. The amount of fluorspar and the other conventional materials mentioned above is 2 to 8 parts by weight, preferably 3 to 6 parts by weight, per 100 parts by weight of the desulfurizer composition composed of quicklime, diamide lime, and calcium carbide. In addition to increasing the desulfurizing ability of the desulfurizer composition further, fluorspar permits easy removal of the slag after desulfurization. The reason for this is not entirely clear, but it is theorized that fluorspar prevents adhesion of calcium silicate to the surface of the lime powder, and decreases the viscosity of the slag.

When the amount of fluorspar and the other conventional materials exceeds 8 parts by weight, refractories will be heavily damaged, and if it is less than 2 parts by weight, the degree of improvement of desulfurizing ability and slag removability is small.

Fluorspar which may be used in this invention contains about 80 to about 98% by weight of $CaF_2$ and up to about 16% by weight of $SiO_2$, $Fe_2O_3$, MgO, etc.

The following Examples and Comparative Examples illustrate the present invention more specifically.

EXAMPLES 1 TO 22 AND COMPARATIVE EXAMPLES 1 AND 2

In each run, the various materials shown in Table 1 or 2 were mixed uniformly in an inert atmosphere to form a powdery desulfurizer composition.

The powdery desulfurizer composition was injected at a rate of 80 to 150 kg/min. through a lance into a torpedo ladle having a capacity of 350 T filled with 300 to 330 T of molten iron having a sulfur content of 0.035 to 0.040% by means of the injection device described in Japanese Laid-Open Patent Publication No. 31518/1974 using dry nitrogen gas as a carrier gas.

The results of the desulfurization are shown in Tables 1 and 2.

The amounts of quicklime [$(\text{quicklime})_1$DL, $(\text{quicklime})_2$DL, or (quicklime)*], diamide lime and calcium carbide in Tables 1 and 2 are by weight % based on the total amount of these three components, and the amounts of the carbonaceous material and fluorspar are expressed by parts by weight per 100 parts by weight of the quicklime, diamide lime and calcium carbide combined.

The materials used in these examples were as follows:

(1) Quicklime

Quicklime suitable for calcium carbide production, which has a CaO content of 95%.

(2) Diamide lime

Diamide lime obtained as a by-product in the production of dicyanidamide from calcium cyanamide. Its chemical composition is: $CaCO_3$ 85% by weight, C 10% by weight, $SiO_2$ 1.8% by weight, $Al_2O_3$ 1.3% by weight, $Fe_2O_3$ 0.8% by weight, MgO 0.7% by weight, and others 0.4% by weight.

(3) $(\text{Quicklime})_1$DL

Obtained by calcining the diamide lime mentioned in paragraph (2) above in the fluidized state at 1000° C. for 30 seconds in excess air using CO gas as a fuel. Its chemical composition is: CaO 72% by weight, $CaCO_3$ 23% by weight, C 1.5% by weight, $SiO_2$ 1.4% by weight, $Al_2O_3$ 0.9% by weight, and others 1.2% by weight.

(4) $(\text{Quicklime})_2$DL

The diamide lime mentioned in paragraph (2) above was calcined under the same conditions as in (3) above except that the calcining time was changed to 45 seconds. The chemical composition of the product was: CaO 90% by weight, $CaCO_3$ 2.1% by weight, C 0.3% by weight, $SiO_2$ 2.7% by weight, $Al_2O_3$ 1.7% by weight, $Fe_2O_3$ 1.0% by weight, and others 2.2% by weight.

(5) (Quicklime)*

The diamide lime described in Table 1, Example Calcination No. 4 of the specification of Japanese Laid-Open Patent Publication No. 86417/1979 was calcined in a nitrogen gas atmosphere at 950° C. for 60 seconds.

(6) Calcium carbide

Industrial carbide having the chemical composition: $CaC_2$ 80% by weight, CaO 13% by weight, $SiO_2$ 2% by weight and others 5% by weight.

(7) Carbon

Obtained by pulverizing commercially available coke. It has a carbon content of 86% by weight.

(8) Fluorspar

Obtained by pulverizing imported fluorspar in the same way as in the preparation of the carbonaceous substance. This fluorspar had the following chemical composition: $CaF_2$ 90% by weight, $SiO_2$ 8.5% by weight, $Fe_2O_3$ 1.0% by weight, and MgO 0.3% by weight.

The particle size distributions (%) of the quicklime, diamide lime, (quicklime)$_1$DL, (quicklime)$_2$DL, calcium carbide and carbon used in these examples were as tabulated below. The (quicklime)* contained at least 85% by weight of particles having a size of 145 mesh or smaller.

| Size | Quick-lime | Di-amide lime | (quick-lime)$_1$DL | (Quick-lime)$_2$DL | Cal-cium car-bide | Car-bon |
|---|---|---|---|---|---|---|
| 70 mesh and larger sizes | 2.0 | 1.0 | 1.5 | 0.5 | 1.0 | 1.0 |
| 70–145 | 1.0 | 0.5 | 0.5 | 0.5 | 1.0 | 0.5 |
| 145–250 | 1.5 | 1.0 | 1.0 | 1.0 | 1.5 | 1.5 |
| 250–350 | 2.5 | 0.5 | 0 | 0.5 | 1.5 | 0.5 |
| 350 mesh and smaller sizes | 93.0 | 97.0 | 97.0 | 97.0 | 95.0 | 96.5 |

The terms used in Tables 1 and 2 have the following meanings.

(a) Unit consumption $$\frac{\text{Weight (kg) of the powdery desulfurizer composition injected into molten iron}}{\text{Weight } (T) \text{ of molten iron treated}}$$

(b) Carrier gas ratio $$\frac{\text{Flow rate (Nl/min.) of the carrier gas}}{\text{Injection rate (kg/min.) of the powdery desulfurizer composition}}$$

(c) Injection pressure

The pressure (kg/cm$^2$) of the carrier gas to be connected to the discharging exit point when the desulfurizer composition is carried on the carrier gas and injected into molten iron (corresponding to a relatively low pressure P3 connected to the discharge opening 4 in FIG. 2 of Japanese Laid-Open Patent Publication No. 31518/1979).

(d) Desulfurizing ability $$\frac{S_1 - S_2 (= \Delta S)}{\text{Unit consumption}}$$

$S_1$ = sulfur content (%) of molten iron before desulfurization $S_2$ = sulfur content (%) of molten iron after desulfurization

Comparative Example 3

Desulfurization was carried out under the same conditions as in Examples 1 to 22 except that a powdery desulfurizer composition composed of 40% by weight of (quicklime)$_1$DL, 40% by weight of diamide lime, 20% by weight of calcium carbide, and 15 parts by weight of carbon per 100 parts by weight of the quicklime, diamide lime, and calcium carbide combined was used. During the injection operation, the temperature of the exhaust gas became exceedingly high, and the operation was too dangerous to continue. Thus, this composition cannot be used for practical purposes.

Comparative Example 4

A powdery desulfurizer composition composed of 50% by weight of quicklime, 50% by weight of calcium carbide was prepared and examined by fundamental injection desulfurization test. Its gas transportability was found to be so bad that it was quite unsuitable for injection into molten iron.

TABLE 1

| Example (Ex.) or Comparative Example (CEx.) | Desulfurizer composition: Quick-lime wt. % | (Quick-lime)$_1$DL wt. % | (Quick-lime)* wt. % | Di-amide lime wt. % | Cal-cium car-bide wt. % | Carbo-naceous substance parts by weight |
|---|---|---|---|---|---|---|
| CEx. 1 | 60 | — | — | 40 | — | — |
| Ex. 1 | 55 | — | — | 40 | 5 | — |
| Ex. 2 | 40 | — | — | 50 | 10 | — |
| Ex. 3 | 20 | — | — | 60 | 20 | — |
| Ex. 4 | 24 | — | — | 56 | 20 | — |
| Ex. 5 | — | 24 | — | 56 | 20 | — |
| Ex. 6 | — | — | 24 | 56 | 20 | — |
| Ex. 7 | 40 | — | — | 40 | 20 | — |
| Ex. 8 | — | 40 | — | 40 | 20 | — |
| Ex. 9 | 64 | — | — | 16 | 20 | — |
| Ex. 10 | — | 64 | — | 16 | 20 | — |
| Ex. 11 | 68 | — | — | 12 | 20 | — |
| Ex. 12 | 35 | — | — | 35 | 30 | — |
| Ex. 13 | 25 | — | — | 35 | 40 | — |
| Ex. 14 | 20 | — | — | 30 | 50 | — |
| CEx. 2 | — | — | — | 10 | 90 | — |
| Ex. 15 | — | 40 | — | 40 | 20 | 5 |
| Ex. 16 | 40 | — | — | 40 | 20 | 10 |
| Ex. 17 | — | 40 | — | 40 | 20 | 10 |

| Example (Ex.) or Comparative Example (CEx.) | Desulfurization conditions: S content of molten iron before desulfurization ($S_1$) % | Gas transportability: Carrier gas ratio Nl/kg | Injection pressure kg/cm$^2$ | Desulfurization results: S content of molten iron after desulfurization ($S_2$) % | Unit consumption kg/T | Desulfurizing ability ΔS/kg |
|---|---|---|---|---|---|---|
| CEx. 1 | 0.040 | 7 | 3.1 | 0.018 | 5.2 | 0.0042 |
| Ex. 1 | 0.036 | 6 | 3.0 | 0.010 | 4.8 | 0.0054 |
| Ex. 2 | 0.038 | 5 | 2.9 | 0.008 | 4.2 | 0.0071 |
| Ex. 3 | 0.036 | 5 | 2.7 | 0.010 | 4.6 | 0.0057 |
| Ex. 4 | 0.036 | 5 | 2.8 | 0.007 | 4.1 | 0.0071 |
| Ex. 5 | 0.036 | 5 | 2.6 | 0.005 | 4.2 | 0.0074 |
| Ex. 6 | 0.035 | 5 | 2.6 | 0.006 | 4.2 | 0.0071 |
| Ex. 7 | 0.039 | 5 | 2.8 | 0.006 | 4.1 | 0.0080 |
| Ex. 8 | 0.040 | 4 | 2.7 | 0.005 | 4.0 | 0.0088 |
| Ex. 9 | 0.038 | 8 | 3.1 | 0.007 | 4.4 | 0.0070 |

TABLE 1-continued

| | | | | | | |
|---|---|---|---|---|---|---|
| Ex. 10 | 0.037 | 5 | 2.7 | 0.006 | 4.3 | 0.0072 |
| Ex. 11 | 0.037 | 10 | 3.0 | 0.010 | 5.0 | 0.0054 |
| Ex. 12 | 0.039 | 6 | 3.0 | 0.005 | 4.0 | 0.0085 |
| Ex. 13 | 0.038 | 6 | 3.1 | 0.005 | 3.8 | 0.0087 |
| Ex. 14 | 0.036 | 7 | 2.7 | 0.009 | 4.1 | 0.0066 |
| CEx. 2 | 0.038 | 12 | 4.2 | 0.011 | 5.1 | 0.0053 |
| Ex. 15 | 0.037 | 4 | 2.6 | 0.003 | 3.7 | 0.0092 |
| Ex. 16 | 0.038 | 4 | 2.7 | 0.004 | 3.8 | 0.0092 |
| Ex. 17 | 0.038 | 4 | 2.6 | 0.002 | 3.6 | 0.0100 |

TABLE 2

| | Desulfurization composition | | | | | Desulfurization condition | Gas transportability | | Desulfurization results | | |
|---|---|---|---|---|---|---|---|---|---|---|---|
| Example | (Quick lime)$_2$ DL wt. % | Diamide lime wt. % | Calcium carbide wt. % | Carbonaceous material parts by weight | Fluorite parts by weight | S content of molten iron before desulfurization ($S_2$) % | Carrier gas ratio Nl/kg | Injection pressure kg/cm$^2$ | S content of molten iron after desulfurization ($S_2$) % | Unit consumption kg/T | Desulfurizability ΔS/kg |
| 18 | 24 | 56 | 20 | — | — | 0.037 | 5 | 2.6 | 0.006 | 4.0 | 0.0073 |
| 19 | 40 | 40 | 20 | — | — | 0.039 | 4 | 2.7 | 0.005 | 3.8 | 0.0039 |
| 20 | 40 | 40 | 20 | 5 | — | 0.037 | 4 | 2.6 | 0.003 | 3.6 | 0.0094 |
| 21 | 40 | 40 | 20 | — | 5 | 0.037 | 4 | 2.6 | 0.003 | 3.6 | 0.0094 |
| 22 | 40 | 40 | 30 | 5 | 5 | 0.037 | 4 | 2.6 | 0.002 | 3.5 | 0.0100 |

As shown in Tables 1 and 2, the powdery desulfurizer compositions of the invention in Examples 1 to 22 did not cause pulsating movement at relatively low injection pressures, and exhibited excellent gas transportability with a carrier gas ratio of less than 10 Nl/kg, and furthermore, they scarcely caused splashing of molten iron from the torpedo ladle. Moreover since the powdery pulverizer composition could be injected at high, concentrations, the inherent desulfurizing ability of quicklime was fully utilized, and the ratio of calcium carbide utilized increases. The desulfurizing ability reached about 0.0055 to 0.0100, and the desulfurized molten iron has the sulfur content of less than 0.01%.

The powdery desulfurizer composition of Example 7 is best in gas transportability and desulfurizing ability among those obtained in Examples 4, 7 and 9. The powdery desulfurizer compositions of Examples 5, 8 and 10 prepared by using (quicklime)$_1$DL are better than those obtained in Examples 4, 7 and 9, and the desulfurizer composition of Example 8 is better in desulfurizing ability than those of Examples 5 and 10. The composition of Example 6 prepared by using the (quicklime)* was slightly inferior in performance to the composition obtained in Example 5. The powdery desulfurizing compositions obtained in Examples 15 to 17 which contain carbon exhibit especially good gas transportability and desulfurizing ability.

The desulfurizer composition of Example 3 consisting mainly of diamide lime causes a tendency to slight increase of splashing. The composition of Example 11 consisting mainly of quicklime shows a tendency to reduced gas transportability and reduced stirring of molten iron by the evolved gases. However, the desulfurizing abilities of the compositions of Examples 3 and 11 are satisfactory. The composition of Example 14 consisting mainly of calcium carbide does not show increased desulfurizing ability corresponding to an increase in the amount of calcium carbide.

The compositions of Examples 18 and 19 which contain the (quicklime)$_2$DL show better desulfurization results than those containing (quicklime)$_1$DL, and the compositions of Examples 20 to 22 which further contain a carbon and/or fluorspar show much better desulfurization results.

Referential Examples 1 and 2

Desulfurization was performed by using the same desulfurizier composition as in Example 17 under the conditions shown in Table 3. The results are shown in Table 3.

TABLE 3

| | Gas transporting conditions | | Desulfurization conditions | Desulfurization results | | |
|---|---|---|---|---|---|---|
| Ex. or Ref. Ex. | Carrier gas ratio (Nl/kg) | Injection pressure | S content in molten iron before desulfurization (%) | S content of molten iron after desulfurization (%) | Unit consumption | Desulfurizing ability (ΔS/kg) |
| Ex. 17 | 4 | 2.6 | 0.038 | 0.002 | 3.6 | 0.0100 |
| Ref. Ex. 1 | 20 | 2.9 | 0.034 | 0.013 | 3.9 | 0.0054 |
| Ref. Ex. 2 | 60 | 2.8 | 0.036 | 0.017 | 4.3 | 0.0044 |

It is seen from Table 3 that the powdery desulfurizing composition obtained in Example 17 which is used at a small carrier gas ratio shows the best desulfurizing performance. As stated hereinabove, the powdery desulfurizing composition shows especially good desulfurizing performance when the carrier gas ratio is not more than 10 Nl per kg of the desulfurizer composition, and this value is suitable for good injection desulfurization.

What we claim is:

1. A powdery desulfurizer composition for injection desulfurization of molten iron, said composition comprising quicklime, diamide lime and calcium carbide the total amount of quicklime and diamide lime being 90 to 60% by weight and the amount of calcium carbide is 10 to 40% by weight with the amount of quicklime being 30 to 80 parts by weight and the amount of diamide lime being 70 to 20 parts by weight provided that the total amount of quicklime and diamide lime being taken as 100 parts by weight and the quicklime being quicklime obtained by calcining diamide lime.

2. The composition of claim 1 which further comprises not more than 10 parts by weight of a carbonaceous material per 100 parts by weight of the composition of any one of claim 1.

3. The composition of claim 1 wherein the quicklime, diamide lime, calcium carbide and the carbonaceous material having particle diameters of mainly not more than 60 microns.

4. The composition of claim 1 which further comprises 2 to 8 parts by weight of one or more desulfurization aids per 100 parts by weight of the composition claim 1.

5. The composition of claim 4 wherein the desulfurization aid is fluorspar.

6. The composition of claim 1, 4 or 5 wherein the injection desulfurization is carried out by fluidizing the powdery desulfurizer composition in a pressure vessel, and injecting the said powdery desulfurizer composition into molten iron using a carrier gas in an amount of not more than 10 Nl per kilogram of the powdery desulfurizer composition.

* * * * *

UNITED STATES PATENT AND TRADEMARK OFFICE

CERTIFICATE OF CORRECTION

PATENT NO. : 4,340,422
DATED : July 20, 1982
INVENTOR(S) : TAKAHASHI ET AL.

It is certified that error appears in the above—identified patent and that said Letters Patent is hereby corrected as shown below:

Claim 2, line 4, delete "claim 1."

Claim 6, line 1, delete "1, 4 or 5" and insert therefore -- 1, 4, 5, 6 or 7 --.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*